United States Patent [19]

Riou et al.

[11] Patent Number: 4,877,686

[45] Date of Patent: Oct. 31, 1989

[54] RECORDING SHEET FOR INK-JET PRINTING AND PROCESS FOR ITS PREPARATION

[75] Inventors: Claude R. Riou, Veyrier Le Lac; Georges M. Gidon, La Balme de Stillingy, both of France

[73] Assignee: Societe Anonyme: Aussedat-Rey, France

[21] Appl. No.: 253,413

[22] Filed: Oct. 4, 1988

Related U.S. Application Data

[63] Continuation of Ser. No. 51,053, May 15, 1987, abandoned.

[30] Foreign Application Priority Data

May 20, 1986 [FR] France ..... 86 07355

[51] Int. Cl.[4] ..... B41M 5/00

[52] U.S. Cl. ..... 428/514; 346/135.1; 428/325; 428/195; 428/211; 428/327; 428/328; 428/330; 428/331; 428/522; 428/323

[58] Field of Search ..... 346/135.1; 428/195, 428/211, 327, 328, 330, 331, 514, 520, 532, 537.5, 522, 323, 325; 427/261, 288

[56] References Cited

U.S. PATENT DOCUMENTS 3,438,808 4/1969 Hawkins et al. ..... 524/405

4,592,951 6/1986 Viola ..... 428/207

FOREIGN PATENT DOCUMENTS 2147003 4/1985 United Kingdom .

OTHER PUBLICATIONS

Abstract Bulletin of the Institute of Paper Chemistry, vol. 56, No. 11, May 1986, p. 1416, No. 12935, Appleton, Wisconsin, US; & JP-A-87.

Abstract Bulletin of the Institute of Paper Chemistry, vol. 56, No. 3, Sep. 1985, p. 409, No. 3615, Appleton, Wisconsin, US; & AP-A-211.

Abstract Bulletin of the Institute of Paper Chemistry, vol. 51, No. 3, Sep. 1980, p. 360, No. 3249, Appleton, Wisconsin, US; & P-A-116.

*Primary Examiner*—Ellis P. Robinson

*Assistant Examiner*—P. R. Schwartz

*Attorney, Agent, or Firm*—Lerner, David, Littenberg, Krumholz & Mentlik

[57] ABSTRACT

Treated base material for recording. The recording sheet for ink-jet printing according to the invention includes, in its coating, a polyhydroxylic polymeric binder with the hydroxyl groups in the cis position, which has been gelled or coagulated with boric acid and/or its derivatives during coating, and a filler with a high absorption capacity. Application to recording paper for ink-jet printing.

6 Claims, 3 Drawing Sheets

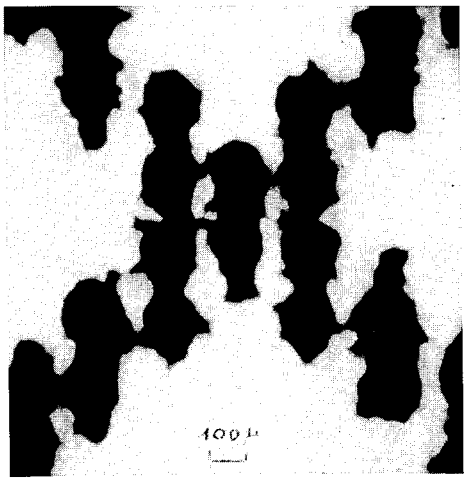
FIG. 4
PRIOR ART
FIG. 5
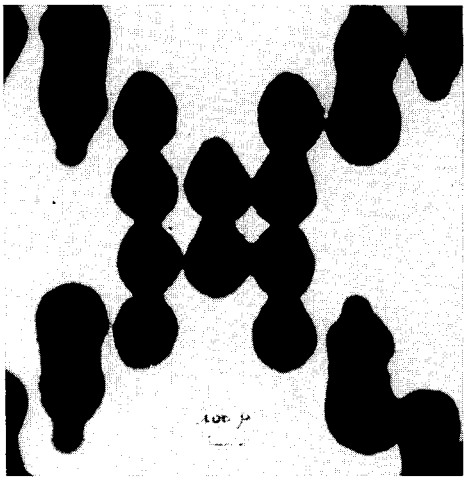
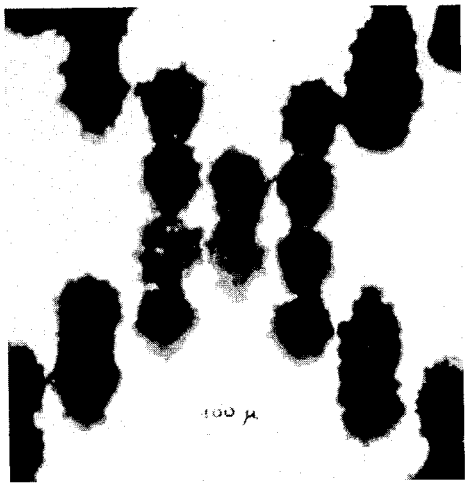
FIG. 6
PRIOR ART

RECORDING SHEET FOR INK-JET PRINTING AND PROCESS FOR ITS PREPARATION

This is a continuation of application Ser. No. 051,053, filed May 15, 1987, now abandoned.

The present invention relates to: a recording sheet for ink-jet printing, and the processes which can be used to prepare the said sheet.

The technique of ink-jet printing is certainly proving successful. Nevertheless, a detailed study of the characters obtained by this technique shows the existence of a number of defects due to the fact that the sheet on which the recording is made is unsuited to the particular characteristics of the ink-jet technique.

A number of publications, in particular patents or patent applications, are already known which propose means of obtaining high-quality sheets for ink-jet printing. Some of these documents, in particular, claim the coating of a base material with a composition containing absorbent fillers of a defined nature or with defined physical properties, which are intended to absorb the ink, or paper bases having particular characteristics, or alternatively a combination of the two.

Thus, for example, U.S. Pat. Nos. 4 269 891 and 4 461 174 recommended the use of absorbent fillers comprising, in particular, silica, diatomaceous earths, zeolite and synthetic or natural silicates.

More recently, Japanese Patent No. 56 148 582 et seq. claimed the use of the same kind of coating filler, and in particular a micropowder of amorphous silica with different synthetic binders.

U.S. Pat. No. 4 440 827 claimed coating with such absorbent compositions in at least two identical coating operations for the purpose of obtaining a high resolution without detracting from the toughness of the layer.

U.S. Pat. No.4 460 637 claimed a particular distribution of pore diameters in the layers of a paper for inkjet printing, the said layers consisting of absorbent fillers.

U.S. Pat. No. 4 478 910 or European Patent No. 0 121 916 claimed the association of a base material containing a small proportion of size and having a very high absorption capacity for aqueous solutions with a layer containing a synthetic binder and a fine silica powder with a BET specific surface area greater than 200 $m^2/g$.

U.S. Pat. No. 4 496 629 may also be mentioned; the said document recommended a layer based on absorbent fillers like silica, this layer being divided into a multitude of lamellae separated by microfissures; according to the inventor, this produces a superior quality.

In the experience of the Applicant, the methods described make it possible to obtain ink-jet prints which, unfortunately, are often affected by quality defects which are difficult and laborious to eliminate. Furthermore, the quality of these prints is very dependent on that of the base material used for the coating operation. Moreover, although U.S. Pat. No. 4 460 637 refers to a relationship between the resolution, the thickness of the layer and the proportion of binder in the layer, there is no publication which clearly describes a means of varying the size of the dots obtained with a defined ink droplet applied by a given ink-jet system.

Although changing certain parameters of the layer (specific surface area, nature and proportion of the binders, thickness of the layer, moisture content) varies the size of the printing dots obtained from ink droplets of given dimensions, defects are observed in the shape and uniformity of these dots:

(a) If the dots are large, they are serrated and of very heterogeneous density. The resulting print has a blurred appearance.

(b) If the dots are small, they are of extremely irregular shape, especially because of hair cracks in the layer which are analogous to those referred to in the teaching of U.S. Pat. No. 4 496 629. In fact, these fissures laterally oppose the horizontal migration of the ink and, conversely, channel it along their length, giving these dots very irregular and unacceptable shapes.

To eliminate these defects, it is possible to alter the base material by modifying its absorption capacity, its structure, the form of its constituent components, its smoothness etc., making it necessary for the quality of the base material to be precisely defined in each particular case.

It is also possible to alter the composition of the layer and the coating method. Thus, hair cracks can be reduced by increasing the proportion of binder, but this presents problems such as the difficulty involved in drying, the increased cost of the composition and the decreased color densities. Hair cracks can also be reduced by lowering the temperature and the drying rate, but this imposes substantial economic limitations. It is also possible to coat in two or more passes, which is the object of U.S. Pat. No. 4 440 827, but here again the economic burden is considerable.

The object of the present invention s to eliminate the above-mentioned defects without suffering the disadvantageous consequences, the difficulties and the costs which result from application of the methods described.

the use of coagulating and gelling products in combination with polyhydroxylic polymeric binders has furthermore been described for different types of paper.

Of the different products which coagulate or gel polyhydroxylic binders, boric acid and/or its derivatives are the best known and in particular the most effective.

The chemical reaction of boric acid and its derivatives with polyhydroxylic binders and the effect obtained are well known and have already been described in detail in a variety of publications.

Boric acid and its derivatives have frequently been used for different industrial applications, of which the following may be mentioned: abrasives, antifreezes, cements and plasters, glues, enamels, fireproofing, metallurgy, pharmaceutical and cosmetic products, tanneries, glassmaking and papermaking.

The properties which are mostly exploited in these numerous applications are their gelling reaction with polyhydroxylic binders, their buffer capacity or their antiseptic properties.

Boric acid and its derivatives have been used in papermaking to achieve different results:

They are used in combination with polyhydroxylic binders to make glues and adhesives for corrugated cardboard, this application being described especially in French Patent Nos. 2 469 439 and 2 331 591. The surface adhesive bond produced in this way provides a barrier to greases, solvents and varnishes, renders the paper or cardboard impermeable to air and also improves the abrasion resistance.

They are used in combination with polyvinyl alcohol to produce a paper which has a barrier effect obtained through gelling of the alcohol, making it possible to fix an ink droplet as soon as it arrives on the surface of the uncoated paper. This application has been described in Japanese Patent Nos. 52 088 406 and 52 126 305 (TOPPAN PRINTING K.K.): a paper is surface-treated with boric acid or a borate or alternatively with an inorganic or organic product capable of coagulating polyvinyl alcohol. This paper is then to be used for heliographic, flexographic or ink-jet printing with a water-based ink containing polyvinyl alcohol.

It should be noted, however, that this reaction involving the gelling or coagulation of polyhydroxylic binders with boric acid and/or its derivatives had so far never been utilized to produce a recording sheet for ink-jet printing which absorbs the ink homogeneously and uniformly, thereby leading to a base material with remarkable properties for recording by ink-jet printing.

The publications of the prior art which mention the use of this reaction on paper for receiving a conventional type of print, such as those by:

B. A. BEARWOOD and EP. CZERWIN - TAPPI, volume 43, 11, pages 944–952 (1960), and B. A. BEARWOOD and C.J. STAPS, Papier, Carton et Cellulose, 13, 2, pages 83–90 (1964), describe a process which, conversely, is intended to impart so-called "barrier" properties to the surface of the printing paper or cardboard, i.e. to make it impermeable to liquids therefore remaining on the surface once they have been deposited on this base material.

The object of the present invention consists in producing a coated printing sheet, suitable for the ink-jet technique, which can be prepared by known papermaking techniques and which eliminates the defects found in the results obtained by using the ink-jet technique on the printing sheets described hitherto.

The object of the invention will be understood more clearly from a comparison of the results obtained, illustrated in the figures which follow.

BRIEF DESCRIPTION OF DRAWINGS:

FIGS. 1 to 6 illustrate results obtained with some known printers using, in two embodiments, an ordinary commercial paper for ink-jet printing, a special paper and a paper according to the invention.

Figure 1:
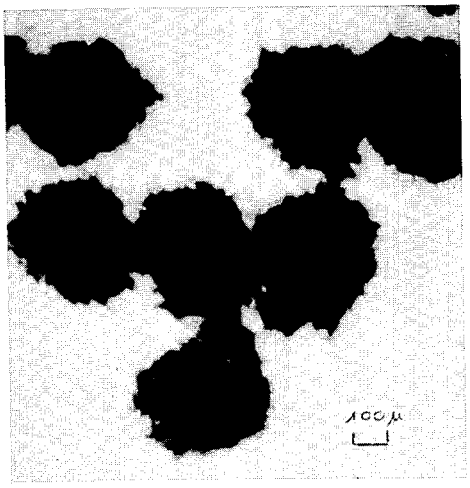
FIG. 1 PRIOR ART

The sheet according to the invention includes, in its coating, a polyhydroxylic polymeric binder with the hydroxyl groups in the cis position, which has been gelled or coagulated with boric acid and/or its derivatives during coating, and a filler with a high absorption capacity.

The polyhydroxylic polymeric binder with the hydroxyl groups in the cis position is preferably of the polyvinyl alcohol or polyvinyl alcohol copolymer type. Examples of products which can be used are described in the book "Polyvinyl alcohol - properties and applications" edited by C.A. FINCH and published by J. WILEY and Sons. Preferably, it will be possible for the characteristics of the polyvinyl alcohol used (degree of hydrolysis and degree of polymerization) to be appropriately selected, in particular as a function of the process for the preparation of the sheet employed.

In the sheet according to the invention, all or a substantial part of this polyhydroxylic polymeric binder has been gelled (or coagulated) by reaction with boric acid and/or its derivatives (e.g. borax), acting as a gelling or coagulating agent.

The amount of gelling (or coagulating) agent used can vary according to the way in which this agent is used. If the said agent is deposited on the base material of the sheet, from 0.05 to 2 $g/m^2$ of boric acid and its derivatives will preferably be used.

The gelling of the polymeric binder has to take place during the coating operation, which is why various processes have been developed; these will be explained later and form part of the invention. It will be noted here that, in the finished product (sheet), a certain proportion of the gelling agent or derivatives of this gelling agent is generally still present, either in the coating layer or in the base material of the sheet or on its surface.

The filler of high absorption capacity which is used in the invention is a material known for its high specific surface area, which can be selected from the group comprising the following products: silica, various silicates, zeolites, calcined kaolins, diatomaceous earths, barium sulfate, aluminum hydroxides and melamine/formaldehyde or urea/formaldehyde pigments.

The relative proportions of the two main constitutents of this coating layer, namely the binder and the filler, can vary within wide limits but are very generally between 10 and 100% by weight of binder, relative to the filler.

It is clear that the coating layer can include additives which are conventionally used in such layers, for example antifoams, surfactants, optical brighteners etc. The weight of the layer is about 0.5 to 20 $g/m^2$.

The present invention also relates to processes for the preparation of the sheets according to the invention.

Any kind of base material will be used, onto which a slip will be deposited. The base material used may be of cellulosic or non-cellulosic type and may have been obtained by a papermaking or other method. It will be possible to use a paper, a cardboard, a synthetic film, a non-woven base material, or the like. The nature and physical properties of the said base material are not critical and depend mainly on the desired type of finished product.

In a first process, the gelling agent will be introduced with the said base material, either by incorporation of the said agent into the base material itself, or by deposition of the said agent on the surface which is to receive the coating. In the latter case, the slip containing the polyhydroxylic polymeric binder and the filler will simply be deposited on the base material containing the said gelling agent, and the gelling of the said binder will take place during the coating operation.

In a second process, the gelling agent will be incorporated into the coating, but the said gelling agent will have to be (temporarily) deactivated beforehand and reactivated when coating is carried out. For example, the inactivated gelling agent can be boric acid, which, although causing an increase in the viscosity of the aqueous medium containing the polyvinyl alcohol, does not cause total gelling of this alcohol. In this case, the gelling takes place by contact between the coating preparation and the base material, the pH of which should preferably be around neutrality.

The base material is coated by conventional roller coating methods (size press, etched roller, bar, reverse roll etc.) or knife coating methods (air knife, trailing blade etc.).

In all cases, the process produces a smooth and defect-free layer in which the thickness variations between points less than 500 microns apart in the plane of the sheet are imperceptible and have no measurable effect. The layer is smoother, has no cracks and is better individualized relative to the base material, the interpenetration zone being reduced.

The advantages of the invention can be summarized as follows:

(1) - With a sheet according to the invention, the quality of the dots obtained by ink-jet printing is superior to that which would be obtained by the processes already described, from the point of view of both their circularity and their internal uniformity, irrespective of their diameter.

(2) - It is therefore possible to increase the range of dot diameters which can be obtained, while at the same time retaining this quality of shape and uniformity of the dots from the minimum diameter to the maximum diameter, which are in a ratio of 1 to 3 (for the same volume of ink droplet).

(3) - The result obtained is no longer so dependent on the quality of the base material used, which can be of virtually any kind, from the point of view of composition, morphology of its constituents (fibers, fillers, etc.), absorption capacity (porosity, sizing etc.), internal structure, surface smoothness etc. The result is an enhanced facility, greater reliability and a reduced manufacturing cost.

(4) - This result can be achieved in a single coating operation, irrespective of the desired size of the dots, without the need to resort to difficult and laborious coating operations in two or more successive stages.

(5) - The invention makes it possible to increase the toughness of the layer.

(6) - It enables the print density to be increased by the fact that the increased toughness of the layer permits modification of the coating formulation and by the fact that the diameter of the dots can be increased under favorable conditions.

The invention therefore enables the quality of the recording sheet to be optimally adapted, more easily and at lower cost, to the type of printer for which it is intended.

the non-limiting examples below illustrate the invention by comparison with the prior art.

EXAMPLE 1

Two different base materials were employed:

(a) a relatively porous, absorbent paper with a low smoothness, characterized by the following tests:

| | |
|---|---|
| AFNOR porosity in air | 2.1 |
| COBB sizing (1 min) | 300 |
| BEKK smoothness | 40 |

(b) the same base paper coated with a 5% solution of borax, resulting in a borax deposit of 0.4 g/m$^2$ of solids.

In a second stage, these two base materials were coated under identical conditions with the following slip:

70 parts by weight of synthetic silica as a fine powder, characterized by an oil uptake of 250 g per gram of powder (measured according to T 30.022 or ISO R 787), 30 parts by weight of a powdered aluminum silicate having a mean particle diameter of 2.5 microns and containing more than 95% of particles with a diameter of less than 10 microns, 30 parts by weight of a polyvinyl alcohol of moderate viscosity (about 7 to 11 cps in 4% solution), with a degree of hydrolysis of 98, and a sufficient amount of water to give a final preparation with a solids content of 10%.

The toughness of the layer and its bonding to the base material were measured by the speed at which the layer starts to tear when printed with a Lorilleux 3802 ink on an IGT AiC 2 machine. The tear speeds and the layer weights are as follows:

| | Speed | Layer weight |
|---|---|---|
| (a) | 60 m/s | 2.5 g/m$^2$ |
| (b) | 110 m/s | 3.5 g/m$^2$ |

These two coated papers were printed by the ink-jet technique on a SIEMENS PT 88 printer, together with a commercial paper (c) sold under the name of Neujet 1/7 as being suitable for this printer, among others. These three papers were printed with the same SIEMENS black ink.

Figure 2:
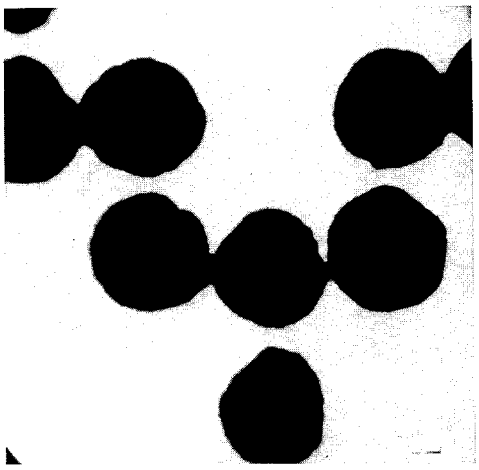
Figure 3:
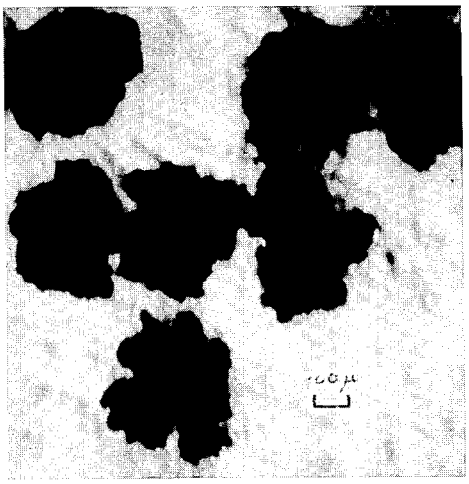
FIG. 3 PRIOR ART

Examination of the print produced on these various papers, illustrated in FIGS. 1 to 3, shows that the dots obtained on the paper coated on the base material using borax (b) are much more regular than those obtained on the other papers. The illustrations in FIGS. 1 to 3 correspond to photographs taken with the same POLAROID SX70 apparatus at the same magnification, under the same lighting conditions and with the same time delays after printing.

EXAMPLE 2

In the same way, two base materials were manufactured from the same base:

(a) a relatively smooth and fairly water-impermeable and air-impermeable paper characterized by the following tests:

| | |
|---|---|
| AFNOR porosity in air | 0.6 |
| COBB sizing (1 min) | 15 |
| BEKK smoothness | 200 |

(b) the same paper coated with a 10% solution of borax, giving a deposit of 0.7 g/m$^2$ of dry borax.

These two base materials were coated with the following slip and dried under identical conditions:

100 parts by weight of synthetic silica of identical quality to that in Example 1, 20 parts by weight of a completely hydrolyzed polyvinyl alcohol with a viscosity of between 26 and 32 cps in 4% solution, and a sufficient amount of water to give a preparation with a solids content of 18%.

The layer deposits and tear strengths are shown in the table below:

| | Layer deposit | Tear speed |
|---|---|---|
| (a) | 10 g/m$^2$ | 6 m/s |
| (b) | 12.5 g/m$^2$ | 41 m/s |

The two papers were printed with a Diablo ink-jet printer (SHARP IO.0700 technology), together with a commercial paper (c) used as a reference for this type of printer. These three papers were printed with the same SCHARP black ink.

Here again, examination of the ink spots obtained clearly shows, when comparing FIGS. 4 to 6, that the said spots are more precise and have a more distinct contour on the paper according to the invention.

Operating conditions identical to those above were used to prepare the basic photographs of the illustrations according to FIGS. 4 to 6.

Figure 7:
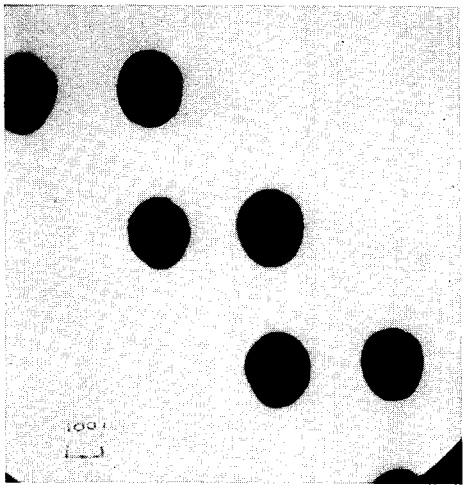
FIGS. 7 to 9 show one of the advantages offered by a paper according to the invention.
Figure 8:
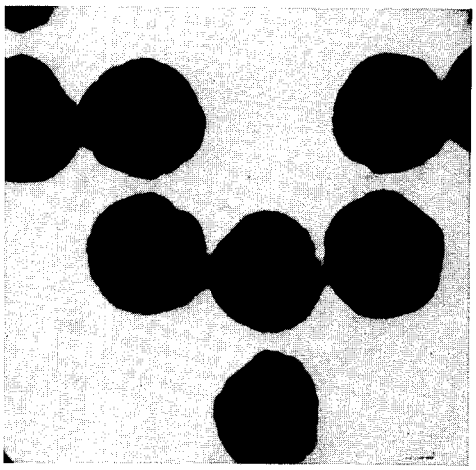
Figure 9:
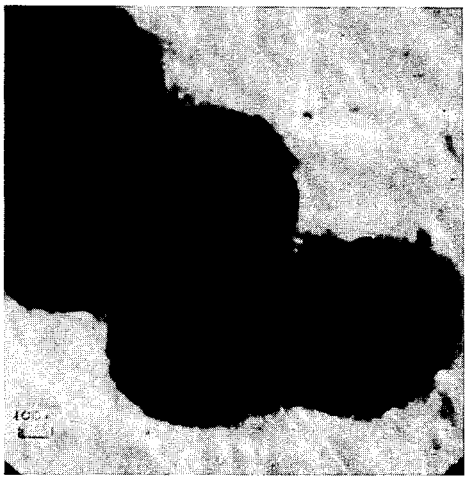

FIGS. 7 to 9 correspond to photographs prepared under the same operating conditions as above, starting from papers treated according to the invention and printed on a SIEMENS PT 88 printer with a SIEMENS black ink. Examination of these figures shows that it is possible to increase the range of dot diameters which can be obtained, while at the same time retaining their previously demonstrated qualities of shape and uniformity. Examination of these figures shows that it is possible to obtain dots of very high quality, the diameters of which are in a ratio of 1 to 3 for the same volume of ink, by changing certain parameters of the paper treatment layer, such as specific surface area, nature and proportion of the binders, thickness and moisture content.

What is claimed is:

1. A recording sheet for use in connection with inkjet printing comprising an opaque base sheet and a surface coating on said base sheet, said surface coating comprising a polyhydroxylic polymeric binder with the hydroxyl groups in the cis position, a substantial portion of said binder having been gelled with a gelling agent selected from the group consisting of boric acid, derivatives of boric acid, and mixtures thereof, and a filler component having high absorption capacity, said binder being present in an amount of from about 10 to 100 percent by weight of the amount of said filler, whereby said filler primarily acts as the ink receptor in said inkjet printing and the shape, size and uniformity of dots of said ink as applied to said recording sheet may be substantially improved thereby.

2. The recording sheet of claim 1 wherein said polyhydroxylic polymeric binder is selected from the group consisting of polyvinyl alcohol and polyvinyl alcohol copolymers.

3. The recording sheet of claim 1 wherein said filler is selected from the group consisting of silica, silicates, zeolites, calcined kaolins, diatomaceous earths, barium sulfate, aluminum hydroxides, melamine/formaldehyde and urea/formaldehyde pigments, and mixtures thereof.

4. The recording sheet of claim 1 wherein said opaque base sheet comprises a cellulosic base sheet.

5. the recording sheet of claim 10 wherein at least a portion of said gelling agent is present in its original form.

6. The recording sheet of claim 1 wherein said coating layer includes an additive selected from the group consisting f antifoam agents, surfactants, optical brighteners, and mixtures thereof.

* * * * *

UNITED STATES PATENT AND TRADEMARK OFFICE

CERTIFICATE OF CORRECTION

PATENT NO. : 4,877,686

DATED : October 31, 1989

INVENTOR(S) : Claude R. Riou and Georges M. Gidon

It is certified that error appears in the above-identified patent and that said Letters Patent is hereby corrected as shown below:

Column 3, line 26, after "liquids" insert --such as oils, water and printing inks, these liquids--.

Column 8, line 20, "the" should read --The--.

Column 8, line 20, delete "10" and insert therefor --1--.

Column 8, line 26, "f" should read --of--.

Signed and Sealed this

Thirteenth Day of November, 1990

*Attest:*

HARRY F. MANBECK, JR.

*Attesting Officer*

*Commissioner of Patents and Trademarks*